United States Patent [19]
Hughes et al.
[11] 4,296,991
[45] Oct. 27, 1981

[54] ELECTRICAL CONNECTOR RECEPTACLE

[75] Inventors: Donald W. K. Hughes, Mechanicsburg; Ronald W. Myers, Landisburg, both of Pa.

[73] Assignee: AMP Incorporated, Harrisburg, Pa.

[21] Appl. No.: 101,676

[22] Filed: Dec. 10, 1979

Related U.S. Application Data

[63] Continuation-in-part of Ser. No. 940,536, Sep. 8, 1978, Pat. No. 4,221,458.

[51] Int. Cl.[3] ..... H01R 13/50
[52] U.S. Cl. ..... 339/176 MP; 339/17 C; 179/1 PC
[58] Field of Search ..... 339/17 C, 91 R, 126 R, 339/176 MP; 179/1 PC

[56] References Cited

U.S. PATENT DOCUMENTS

| | | | |
|---|---|---|---|
| 3,399,377 | 8/1968 | Warzecka | 339/176 |
| 4,071,696 | 1/1978 | Anderson | 179/1 PC |
| 4,153,327 | 5/1979 | Johnson | 339/205 |
| 4,186,988 | 2/1980 | Kobler | 339/17 C X |
| 4,225,209 | 9/1980 | Hughes | 339/126 R |
| 4,239,316 | 12/1980 | Spaulding | 179/1 PC X |

*Primary Examiner*—Eugene F. Desmond
*Attorney, Agent, or Firm*—Frederick W. Raring; F. Brice Faller

[57] ABSTRACT

A jack-type electrical connector receptacle is disclosed which is intended for mounting on a circuit board with the rearward end of the connector against the surface of the circuit board. The side-by-side conductors are stamped and formed members which extend through spaced-apart openings in the connector housing and diagonally into the plug-receiving opening of the housing. Intermediate portions of the conductors extend across an external sidewall of the housing, past the rearward end of the housing. The conductors are offset and spread apart at their rearward ends which are intended to be inserted into holes in the circuit board.

4 Claims, 8 Drawing Figures

FIG. 4
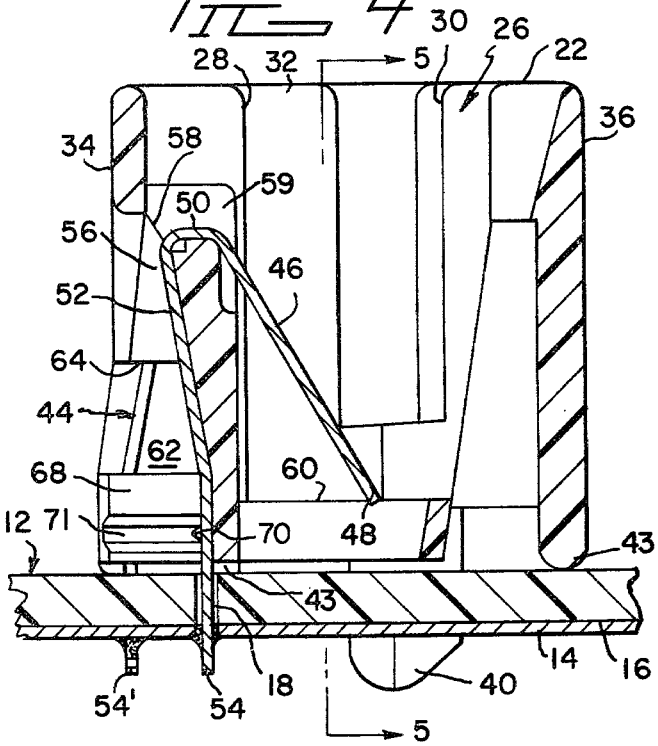
FIG. 5
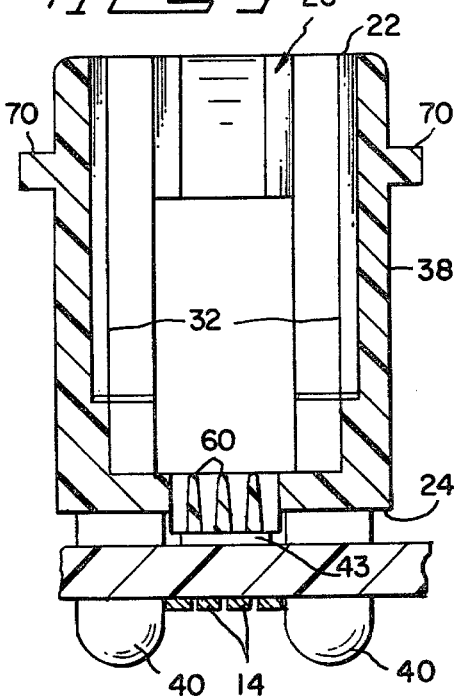
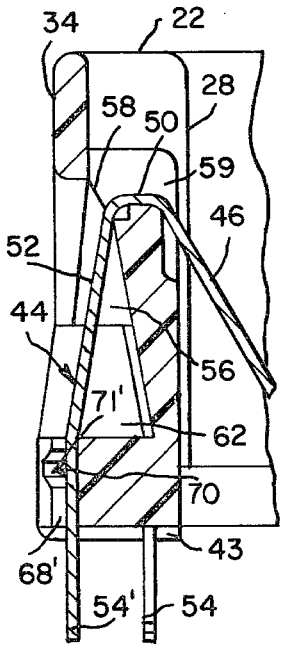
FIG. 6
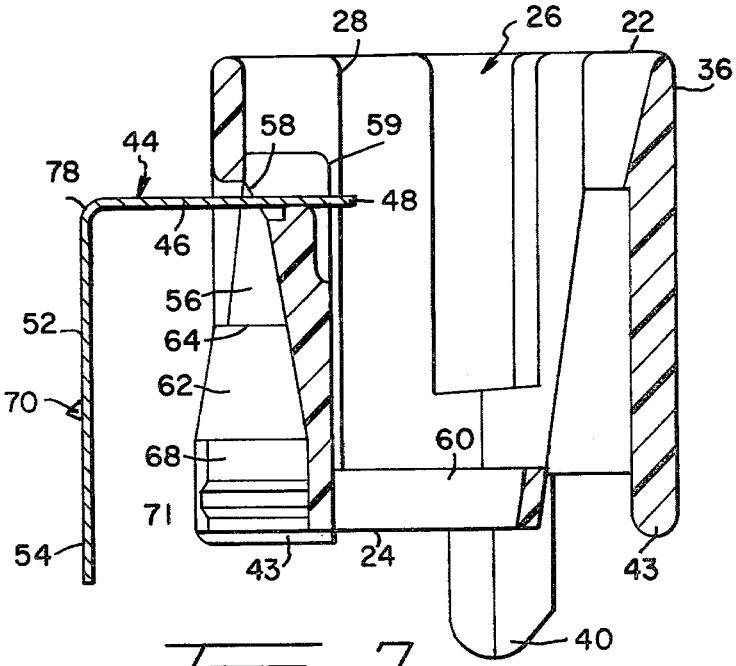
FIG. 7

ELECTRICAL CONNECTOR RECEPTACLE

This Application is a Continuation-in-part of Application Ser. No. 940,536, filed Sept. 8, 1978, now U.S. Pat. No. 4,221,458, issued Sept. 9, 1980.

FIELD OF THE INVENTION

This invention relates to electrical connector receptacles, or jacks, as they are commonly called, of the type used in the telecommunications industry and described generally in the Federal Communications Commission documents published in the Federal Register on July 12, 1976, pages 28694–28782.

BACKGROUND OF THE INVENTION

The Federal Communications Commission documents referred to above set forth standards for electrical connector receptacles or jacks and mating connector plugs which are to be used in the telecommunications industry to achieve standardization of a wide variety of types of equipment used by the industry and used in conjunction with communications equipment. These documents set forth essential dimensions for the jacks and plugs but they leave room for innovation and improvement in the manufacture and performance of the plugs and jacks. A widely used type of jack or receptacle is described in detail in U.S. Pat. No. 3,850,497 and a commonly used type of connector plug is described in U.S. Pat. No. 3,954,320.

Application Ser. No. 940,536 discloses and claims a connector receptacle which satisfies all of the requirements of the Federal Communications Commission documents and which differs from the receptacle shown in U.S. Pat. No. 3,850,497 in that it has one-piece conductors mounted in the housing which have end portions that extend beyond one of the external sidewalls of the housing and which can be inserted into holes in a circuit board and connected to conductors on the circuit board.

Application Ser. No. 967,441 discloses and claims an improved version of the receptacle shown in the earlier application which permits mounting the receptacle on a circuit board in a manner such that the latching arm of the plug mated with the receptacle is not immediately accessible so that removal of the plug from the receptacle is discouraged. Application Ser. No. 14,442 discloses and claims a receptacle with improved mounting means, and barriers between conductors to maintain separation of free ends and preclude impalement of a small child's finger. Connector receptacles as disclosed in Applications Ser. Nos. 940,536, 967,441, now Patent No. 4,193,654, issued Mar. 18, 1980 and 14,442, now Patent No. 4,210,376, issued July 1, 1980, are favorably viewed by the industry in that they can be mounted on a circuit board more conveniently than previously available jacks or receptacles and have other advantageous features.

The present invention is directed to the achievement of an improved receptacle incorporating some of the principles of the receptacle disclosed and claimed in Application Ser. No. 940,536 and which is intended to be mounted on a circuit board with a rearward end of the connector receptacle housing against the circuit board. Receptacles capable of being mounted in this orientation, with the rearward end of the housing against the circuit board, are required under many circumstances in which conductors and a modular plug are to be disengageably connected to conductors on a circuit board.

A connector receptacle, in accordance with the present invention, comprises a one-piece insulating housing having a plug-receiving end, a rearward end, and a plug-receiving opening extending into the plug-receiving end. The conductors are stamped and formed sheet metal members which extend through side-by-side apertures in one of the external sidewalls of the housing and the conductors have contact spring portions which are reversely bent and extend obliquely into the plug-receiving opening. The apertures are spaced from the plug-receiving end of the housing and the side-by-side conductors are maintained in parallel spaced-apart relationship by virtue of the fact that each conductor is received in one of the apertures. Intermediate portions of the conductors extend from the apertures rearwardly across the adjacent external sidewall and past the rearward end of the housing. Alternate conductors are offset from each other and the intermediate portions of the conductors diverge from each other on this external sidewall so that the second end portions of the conductors are located on triangular centers. The offsetting of the conductors is achieved by the provision of alternately deep and shallow channels in the adjacent external sidewall of the housing. A connector, in accordance with the invention, can be manufactured by simply stamping the conductors from a continuous strip of conductive metal, bending a group of conductors equal to the number of conductors required in a connector, and assembling the group of conductors to the housing in a relatively simple assembling and forming process.

The disclosures of U.S. Applications Nos. 940,536, 967,441, and 14,442 are hereby incorporated by reference.

DESCRIPTION OF THE DRAWINGS

FIG. 4 is a cross-sectional view taken along line 4—4 of FIG. 3, as assembled to circuit board.

FIG. 5 is a cross-sectional view taken along line 5—5 of FIG. 4.

FIG. 6 is a partial cross-sectional view taken along line 6—6 of FIG. 3, without the circuit board.

FIG. 7 is a cross-sectional view similar to FIG. 4, but showing the conductors prior to assembly to the housing, prior to assembly to the circuit board.

DESCRIPTION OF THE PREFERRED EMBODIMENT

Figure 1:
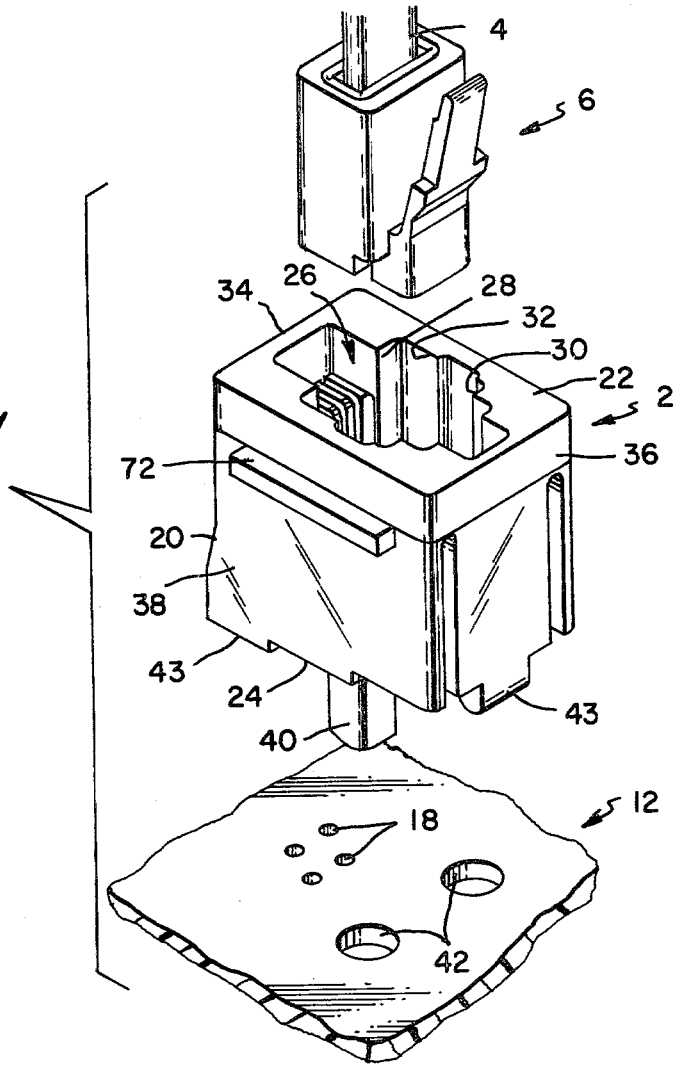
FIG. 1 is a perspective view of a connector receptacle in accordance with the invention shown exploded from a circuit board with a plug exploded from the receptacle.

Referring first to FIGS. 1 and 4, an electrical connector receptacle or jack 2, in accordance with the invention, serves to connect conductors in a cable 4 to conductors 14 on the underside 16 of a circuit board 12. The conductors 14 extend to holes 18 in the circuit board which receive the end portions 54, 54' of conductors 44 in receptacle 2 so that the conductors 44 can be soldered to the circuit board conductors 14. The cable 4 has a standard plug 6 on its end and the conductors in the cable are in electrical contact with contact members in the plug which engage contact springs 46 when the plug is inserted into the receptacle 2, as will be described below.

Figure 3:
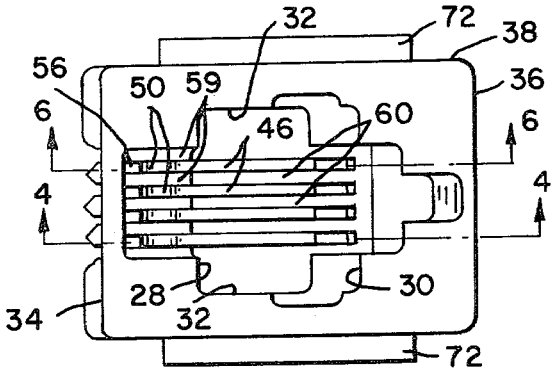
FIG. 3 is a plan view of the plug-receiving end.

The receptacle 2 comprises a one-piece molded housing 20 of suitable plastic material, such as a filled nylon, having a plug-receiving end 22, a rearward end 24, and having a plug-receiving opening 26 extending into the plug-receiving end 22. The opening 26 has first and second internal sidewalls 28, 30 and opposed internal endwalls 32, as shown in FIG. 3. The housing has first and second external sidewalls 34, 36 which are proximate to the internal sidewalls 28, 30 respectively and oppositely directed external endwalls 28. Mounting posts 40 extend from the rearward end 24 and are dimensioned to enter spaced-apart holes 42 in the circuit board 12 and feet 43 are provided on the rearward end to elevate this end above the upper surface of the circuit board when the housing is mounted thereon, as shown in FIG. 4. This permits any excess solder from a wave soldering operation to run out of the housing before it solidifies.

Referring to FIGS. 4 and 6, a plurality of side-by-side stamped and formed conductors generally indicated at 44 are contained in, and on, the housing. Each conductor has a contact spring portion 46 having a first end portion 48, a reverse bend 50, an intermediate section 52 which extends rearwardly from the reverse bend toward a second end portion 54, 54'. Second end portions 54, 54' are intended for insertion into the holes 18 of the circuit board and are offset from each other so that they can be received in circuit board holes which are arranged in a triangular pattern.

Figure 2:
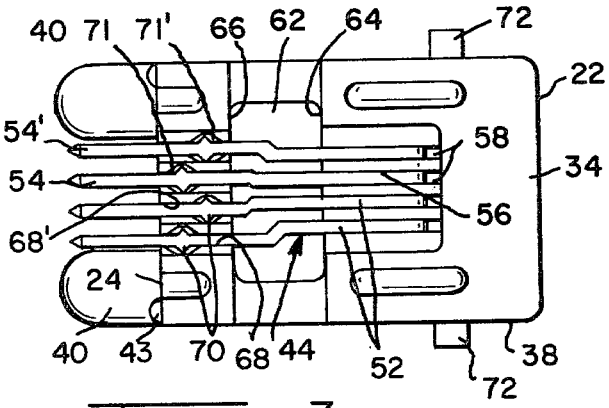
FIG. 2 is a plan view of the external sidewall with the conductors thereon.

Referring to FIG. 2, intermediate portions 52 of the conductors are disposed in parallel first channel portions 56 in first external sidewall 34. These channel portions extend from a first end 64 of a recess 62 in the first external sidewall 34 to spaced-apart apertures 58 which are adjacent to, but spaced from the plug-receiving end 22. These apertures are completely enclosed and the reverse bends 50 of the conductors 44 extend through these apertures and around conforming surfaces of the housing, as shown in FIGS. 4 and 6. The internal sidewall 28 has spaced-apart parallel recesses 59 which are dimensioned to receive the contact spring portions 46 of the conductors when the plug is inserted. Upon insertion of the plug the springs 46 are flexed in a clockwise direction as viewed in the drawings and resiliently engage the exposed contact members of the plug.

Referring to FIGS. 4 and 5, a plurality of parallel spaced-apart barriers 60 extend across opening 26 from the first internal sidewall 28 toward the second internal sidewall 30 adjacent to the rearward end 24 and these barriers define stalls which receive the first end portions 48 of the contact springs 46. These barriers serve to keep the contact springs from short circuiting against each other and further preclude the possibility of a small child inserting his finger in the plug opening and being impaled on the ends 48 of the conductors. Note that the first channel portions 56, recesses 59, and barriers 60 are aligned to receive parallel conductors.

As shown in FIG. 2, second channel portions 68, 68' are provided in the first external sidewall 34 between a second end 66 of the recess 62 and the rearward end 24 of the housing. The channels 68 are relatively deep while the channels 68' are comparatively shallow. The conductors extend across the recess 62 from the first end 64 to second end 66 thereof, and second end portions 54, 54' are received in the second channel portions 68, 68' respectively, then extend normally of and beyond the rearward end 24 of the housing. The second end portions of the conductors are spread apart in two senses: the conductors diverge to a greater parallel spacing as they cross the recess 62, wherefore the second channel portions 68, 68' are spaced further apart than the first channel portions 56; and additionally the second end portions 54' are offset from the second end portions 54, wherefore the channels 68, 68' are alternately deep and shallow. The deep channels 68 receive the end portions 54 and the shallow channels 68' receive the end portions 54'. Barbs 70 are provided on the second end portions of the conductors 54, 54' and these are received in recesses 71, 71' in the sidewalls of the channels 68, 68' respectively to retain the conductors in the channels.

As shown in FIGS. 1 and 2, flanges 72 extend from the external endwalls 38 just below the plug-receiving end 22 so that when the receptacle is mounted on a circuit board a panel can be provided with an opening dimensioned such that the plug-receiving end is received in the opening. The flanges 72 will then extend beyond the edges of opening and present a pleasing and neat appearance from the outside of the panel. This arrangement thus facilitates manufacture of equipment using standard modular receptacles.

Figure 8:
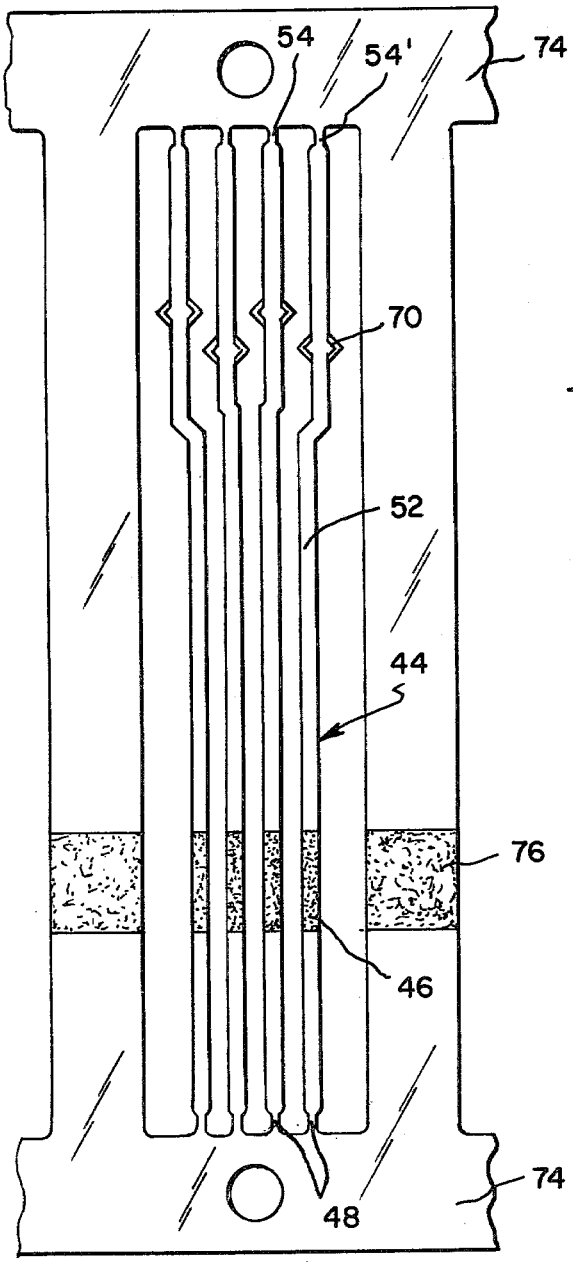
FIG. 8 is a plan view of a strip of conductors.

In the manufacture of the receptacle, the conductors are produced as a continuous strip by stamping and forming it as shown in FIG. 8. The barbs 70 are offset from each other because of the close spacing of the conductors in the housing, recesses 71, 71' are likewise offset in second channel portions 68, 68' respectively. The conductors are assembled to the housings by first removing the carrier strip 74 from the first ends 48 of the conductors, forming a right angle bend 78, and positioning the section of strip above a housing, as shown in FIG. 7, with the conductors in alignment with the apertures 58. The section of strip is then moved so that bends 78 lie within the apertures 58. At this stage, the first ends 48 of the conductors will be adjacent to the second internal sidewall 30 and it should be noted that the opening must be dimensioned such that there is sufficient clearance at the sidewall 30 for these conductors. The spring portions 46 of the conductors can then be bent inwardly by insertion of a suitable gage. The portions of the conductors which lie over the first external sidewall are moved laterally by varying amounts to position them in the channels 56 and 68, 68'. The carrier strip 74 must be removed from the second ends 54, 54' before this final stage is carried out.

As explained above, the disclosed embodiment avoids the hazards of injury by insertion of a finger into the plug-receiving opening and avoids the possibility of shorting of conductors by careless misuse or intentional abuse. An additional advantage is that the apertures 58 are spaced from the plug-receiving end of the housing by a distance which is greater than that of known receptacles and relatively speaking, the contact spring portions of the conductors are shorter, other things being equal, than the contact spring portions of previously known receptacles. These shortened contact springs produce stiffer springs which means that a thinner gage material for the conductors can be used without sacrifice of contact force.

An important feature of this invention is the plated section 76 of the strip, which is located so that it will lie on the contact spring portions of the assembled receptacle. The noble metal used to plate this section improves electrical contact with contact members in the plug.

The advantage here is that the stamped and formed sheet metal strip may be selectively plated, which cannot be readily done with wire conductors. Thus the contact reliability of a precious metal interface may be obtained economically.

A further advantageous feature of the invention is that, notwithstanding the fact that the ends 54 of the conductors are offset from the ends 54', the conductors themselves can all be of the same length as shown in FIG. 8. This is possible since relatively deep second channel portions 68 are the same distance below the first channel portions 56 as relatively shallow second channel portions 56' are above the first channel portions. In previous embodiments of connector plugs, offset conductors were achieved by providing conductors in two different lengths.

We claim:

1. An electrical connector receptacle of the type comprising an insulating housing having a plug-receiving end and a rearward end, a plug-receiving opening extending into said plug-receiving end, said opening having opposed first and second internal sidewalls and opposed internal endwalls, said housing having oppositely directed first and second external sidewalls, which are proximate to said first and second internal sidewalls respectively, and opposed external endwalls, a plurality of spaced-apart side-by-side conductors, each of said conductors having a contact spring portion which extends from said first internal sidewall at a location adjacent to said plug-receiving end diagonally into said opening and towards said rearward end, said connector receptacle being characterized in that:

each of said conductors comprises a one-piece stamped and formed sheet metal member, said first external sidewall has a plurality of side-by-side conductor-receiving channel means therein extending from said location adjacent to said plug-receiving end to said rearward end, every other said channel means being of increasing depth along its length from said location to said rearward end, the remaining channel means being of decreasing depth along their length whereby said channel means are alternately deep and shallow at said rearward end, intermediate portions of said conductors being in said channel means, said conductors having reverse bends at said location and extending diagonally toward first end portions in said opening, second end portions of said conductors extending normally of, and beyond, said rearward end whereby, said contact springs are formed between said reverse bends and said first end portions, and said second end portions of adjacent conductors are offset from each other and can be inserted into holes in a circuit board which are on staggered centers.

2. A connector receptacle as set forth in claim 1 having mounting posts means extending from said rearward end for mounting said receptacle on a circuit board.

3. A connector receptacle as set forth in either of claims 1 or 2, said channel means being laterally divergent along their lengths with respect to a centerline extending across said first external sidewall medially between, and parallel to, said external endwalls whereby, said second end portions of said conductors are spaced apart by distances which are greater than the spacing between said first end portions.

4. A connector receptacle as set forth in claim 3, said first external sidewall having a recess therein, said recess having a first end which is proximate to, and spaced from, said location and having a second end proximate to, and spaced from said rearward end, each of said channel means comprising a first channel portion which extends from said location to said first end and a second channel portion which extends from said second end to said rearward end of said housing, said second channel portions being spaced apart by distances which are greater than the spacing between said first channel portions, said conductors extending across said recess and diverging laterally from each other in said recess.

* * * * *